US005964214A

United States Patent [19]

Ferlin et al.

[11] Patent Number: 5,964,214

[45] **Date of Patent: *Oct. 12, 1999**

[54] RADIANT GAS BURNER ASSEMBLY FOR BROODERS

[75] Inventors: William J. Ferlin, Franklin; Bryan K. Cofer, Oakridge; Anthony W. Simpson, Jacksboro; Gary E. Berry, LaFollette, all of Tenn.; Nelson G. Mayer, Rochester, Mich.

[73] Assignees: Lincoln Brass Works, Inc., Nashville, Tenn.; a part interest; Sibley Industries, Inc., Andereson, Mo.; a part interest

[ * ] Notice: This patent issued on a continued prosecution application filed under 37 CFR 1.53(d), and is subject to the twenty year patent term provisions of 35 U.S.C. 154(a)(2).

[21] Appl. No.: 08/641,002

[22] Filed: Apr. 29, 1996

[51] Int. Cl.[6] ..... F24C 3/04

[52] U.S. Cl. ..... 126/92 B; 431/328; 239/554; 119/307; 119/305

[58] Field of Search ..... 431/328, 329, 431/354, 355; 239/554, 555; 126/85 A, 92 B; 119/305, 307

[56] References Cited

U.S. PATENT DOCUMENTS

| | | | |
|---|---|---|---|
| 600,166 | 3/1898 | O'Rielly | 239/554 |
| 2,985,137 | 5/1961 | Horne | 119/307 |
| 3,289,731 | 12/1966 | Geber | 431/354 |
| 3,777,985 | 12/1973 | Hughes et al. | 239/555 |
| 3,992,137 | 11/1976 | Streisel | 239/554 |
| 4,165,963 | 8/1979 | Nozaki | 239/554 |
| 4,719,874 | 1/1988 | Maurice . | |
| 4,872,833 | 10/1989 | Kramer | 431/354 |
| 4,919,084 | 4/1990 | Maurice . | |
| 5,328,357 | 7/1994 | Riehl | 431/354 |
| 5,545,036 | 8/1996 | Kwiatek | 126/39 E |

OTHER PUBLICATIONS

Maywick Brooders, (Brochure) *Turkey Brooding Systems For The Next Century*, 1 pg., No Date.

Shenandoah Manufacturing Co., Inc., (Brochure) *Radiant Gas Brooders*, 2 pgs., No Date.

Sibley Industries Inc., (Brochure) *Sibley Sierra, Advanced Brooder Technology*, 4 pgs, No Date.

*Primary Examiner*—Carroll B. Dority

*Attorney, Agent, or Firm*—Harness, Dickey & Pierce, P.L.C.

[57] ABSTRACT

A gas burner assembly for a brooding house has a gas burner which is fabricated from a precision steel stamping process. The gas burner has a venturi tube which extends between an orifice fitting and a burner head. The burner head is manufactured from an upper and a lower burner head. Each upper and lower burner head defines a plurality of burner ports with the ports of the lower burner head being in registry with the ports in the upper burner head to define the ports in the upper burner head to define the ports for the gas burner. The upper and lower burner heads are mechanically connected by a series of tabs and slots formed on the upper and lower burner head.

10 Claims, 3 Drawing Sheets

RADIANT GAS BURNER ASSEMBLY FOR BROODERS

FIELD OF THE INVENTION

The present invention relates to radiant gas burner assemblies for brooders. More specifically, the present invention relates to radiant gas burner assemblies for brooders which incorporate a unique gas burner manufactured from stamped stainless steel.

BACKGROUND OF THE INVENTION

For many years, the poultry industry has recognized the importance of providing growing birds with the freedom to choose the most comfortable warmth at any one moment. In order to provide these micro-climates and be able to precisely control them at the liter level, the poultry industry has relied on radiant gas heating systems. These gas heating systems typically include a plurality of gas burner assemblies located throughout the brooding house.

The most popular radiant gas burner assemblies in use today are the radiant screen type burner which are suspended above the flock of growing birds at various spaced locations within the brooding house or barn. These radiant screen type burner assemblies each utilize a cast iron multi-port burner head which directs a burner flame such that the flame impinges on a frusto-conical screen located around the burner head. A reflector, normally manufactured from aluminum, is located above the multi-port burner head and above the frusto-conical screen to reflect the heat generated by the burner downward towards the growing birds. By strategically locating a plurality of these individual burner assemblies throughout the brooding house or barn, it is possible to provide an environment which is conducive for the growth of the birds in the flock.

One problem which is somewhat unique to the brooding systems of the poultry industry is that of air born contaminants consisting of fine dust from the unpaved brooder floors which is kicked up by the young birds and contaminants from the young birds themselves. The prior art cast iron burners suffer from performance problems because of the rough interior surfaces and irregular hole sizes which are inherent of the casting process. Undersized ports, tiny crevices and irregular interior surface features of the burner are areas for build up of dust and other contaminants that can adversely affect both the heating performances of the burner and the emissions generated by the burner. Some manufacturers of these prior art cast iron burners resize the ports with a secondary drilling and/or reaming operation and then add dust filter cans that require cleaning every two or three weeks. The additional machining operations, the addition of the dust filter cans and the continued maintenance of these systems add significant costs to the overall costs of raising the young birds.

The dust collection and contamination problems are not only a problem for the prior art burner ports, they also provide problems in the venturi tubes which supply the fuel to the burners. The venturi tubes are essentially in the horizontal mode as well as vertically oriented orifice fittings that include a substantially large flat face. This flat face provides a settling station for the air burn contaminants which will then have a tendency to adversely affect the operation of the venturi tube and the orifice fitting which in turn adversely affect the performance of the burner.

Accordingly, the continued development of radiant gas heaters for brooding systems is directed to a lower cost burner which resolve the problems associated with radiant gas burner assemblies for brooders.

SUMMARY OF THE INVENTION

The present invention provides the art with a stainless steel burner for use in a radiant gas burner assembly for brooders. The stainless steel burner is fabricated from a precision metal stamping process to provide smooth interior surfaces and controlled port sizes to give equivalent performance from burner to burner. The burner head is significantly lighter than the prior art cast iron version, has a common top and bottom and is mechanically joined rather than welded to provide an overall low cost burner.

Other advantages and objects of the present invention will become apparent to those skilled in the art from the subsequent detailed description, amended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
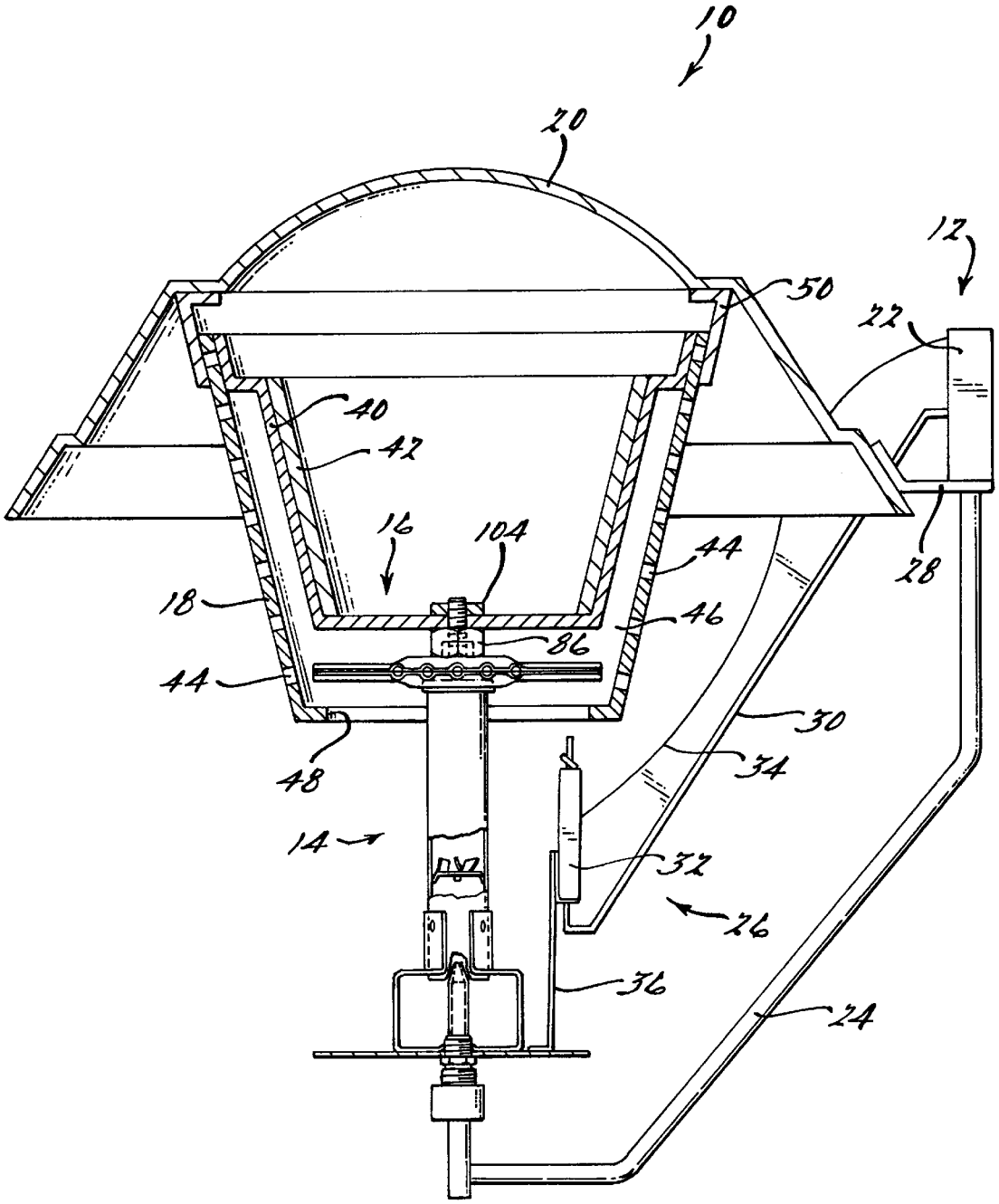
FIG. 1 illustrates a side view partially in cross section of a radiant gas burner assembly in accordance with the present invention.

Referring now to the drawings in which like reference numerals designate like or corresponding parts throughout the several views, there is shown in FIG. 1, a radiant gas burner assembly in accordance with the present invention which is designated generally by the reference number 10. Burner assembly 10 comprises a gas supply system 12, a gas burner 14, an inner core 16, a radiant element 18 and a canopy 20.

Gas supply system 12 comprises a gas control valve 22, a main gas supply tube 24 and a pilot assembly 26. Gas control valve 22 is attached to canopy 20 using a bracket 28 and receives gas from a gas supply source (not shown) which supplies gas to all of burner assemblies 10 located within a brooding house (not shown) or other typical structures. Main gas supply tube 24 extends between gas control valve 22 and gas burner 14 to supply gas for heating purposes. Pilot assembly 26 is attached to gas burner 14 and includes a pilot gas tube 30, a pilot burner 32 and a thermocouple 34. Pilot burner 32 is attached to gas burner 14 using a bracket 36. Pilot gas tube 30 extends between pilot burner 32 and control valve 22 to provide gas for the pilot flame. Thermocouple 34 is positioned within the pilot flame and is in electrical communication with control valve 22 to control the supply of gas to both pilot burner 32 and gas burner 14. The operation of control valve 22 and thermocouple 34 are well known in the art and will not be discussed further herein.

Inner core 16 comprises a solid metal frusto-conical cup-shaped housing 40 which is attached at its smaller diameter end to gas burner 14. A layer of insulative material 42 is located along the inner surface of the side walls of housing 40 to direct a majority of the heat produced by gas burner 14 towards radiant element 18. Radiant element 18 is also a frusto-conical shaped component manufactured from perforated metal, which defines a plurality of apertures 44. Radiant element 18 is attached to the upper end of inner core 16 and is positioned in a generally coaxial relationship with inner core 16 to define a combustion chamber 46. The lower end of radiant element 18 defines an aperture 48 which allows combustion air to enter chamber 46 as well as allowing access for the flame of pilot burner 32 to extend adjacent to the outlet of gas burner 14. Canopy 20 is preferably manufactured from aluminum and is attached to the upper end of radiant element 18 and inner core 16 using a plurality of brackets 50. Canopy 29 reflects the heat generated by gas burner 14 and radiant element 18 downward toward the floor of the brooding house. Burner assembly 10 is suspended above the floor of the brooding housing providing radiant heat to the floor of the brooding house due to the reflection of the heat by canopy 20.

Figure 2:
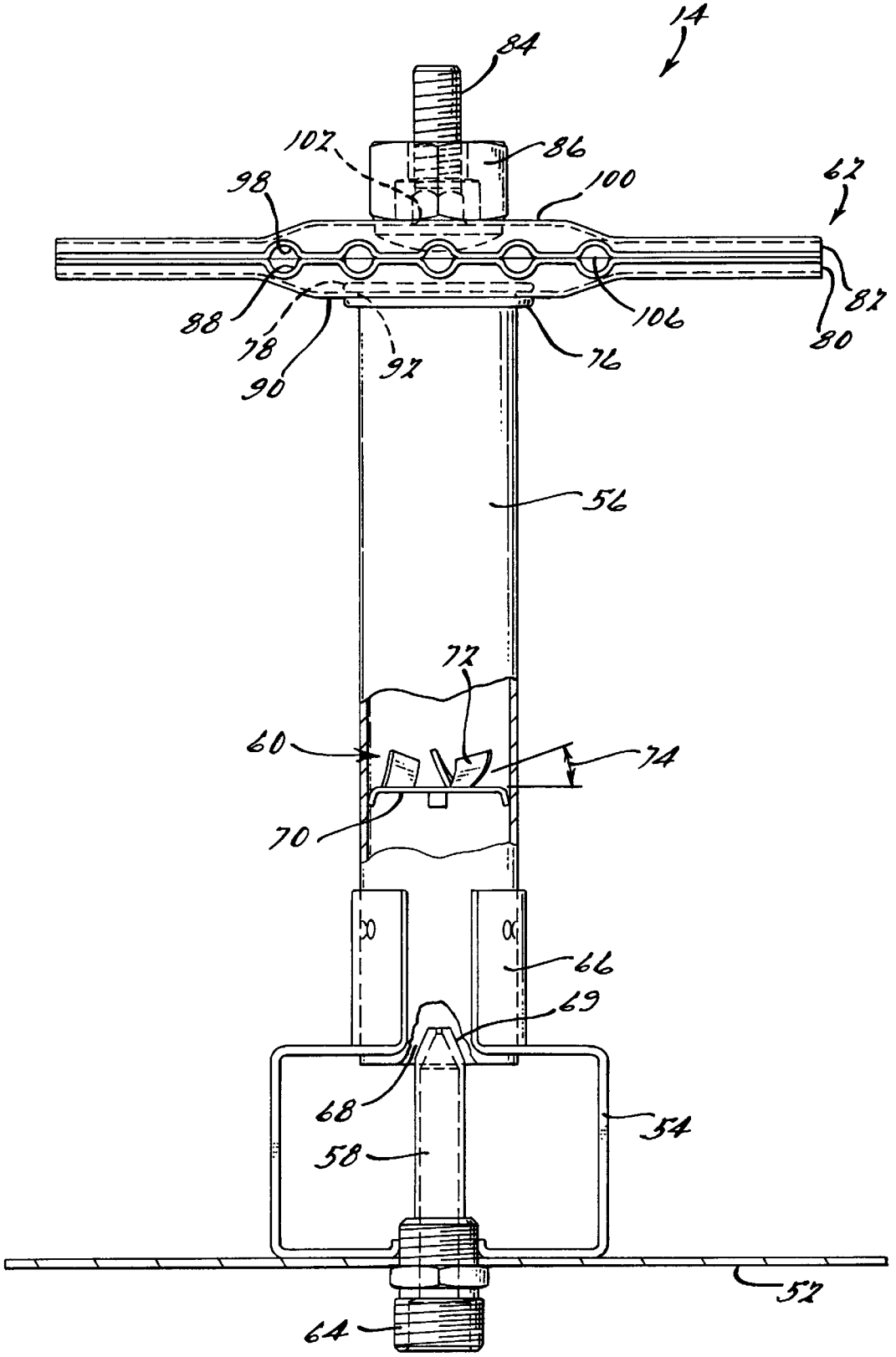
FIG. 2 illustrates a side view of the gas burner shown in FIG. 1.
Figure 3:
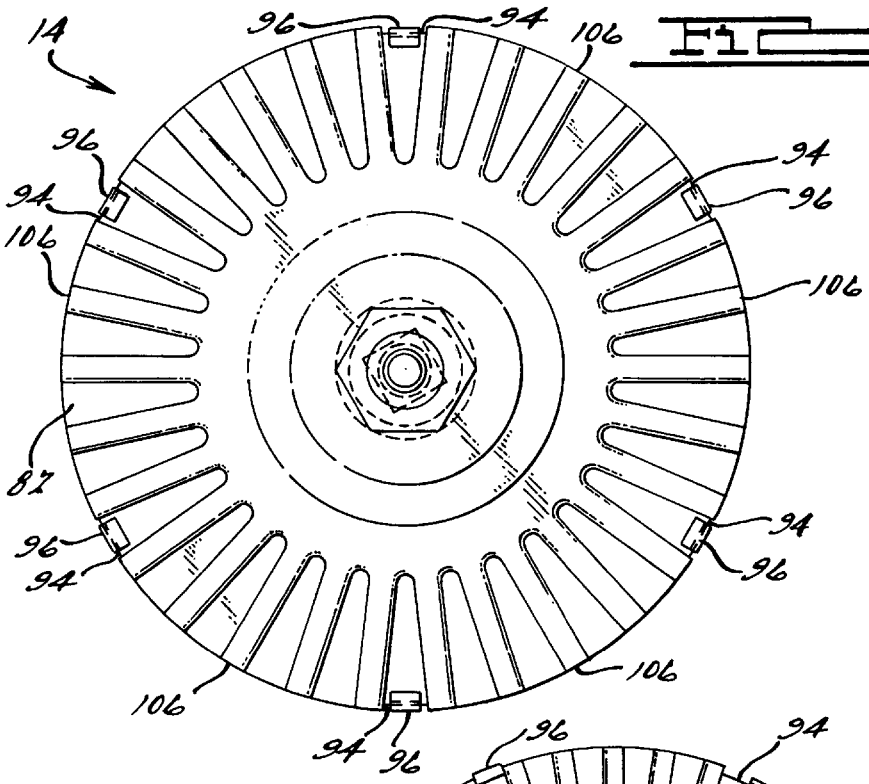
FIG. 3 illustrates a top view of the gas burner shown in FIG. 2.
Figure 4:
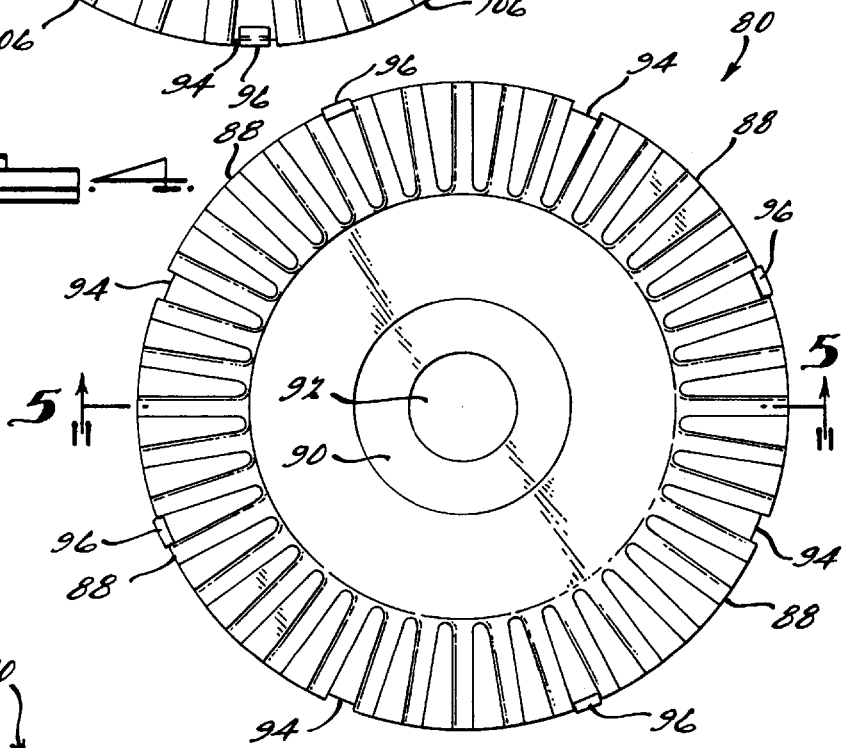
FIG. 4 is a top plan view of the lower burner head shown in FIG. 2.
Figure 5:
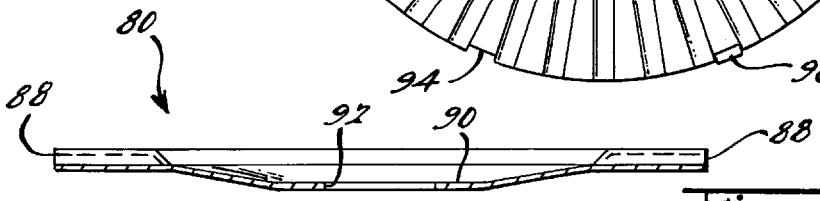
FIG. 5 is a cross-sectional side view of the lower burner head shown in FIG. 4 taken in the direction of arrows 5—5.

Referring now to FIGS. 2 and 3, gas burner 14 is a unique burner fabricated from a precision metal stamping process. Gas burner 14 comprises a particle catching pan 52, a bracket 54, a venturi air tube 56, an orifice fitting 58, a turbo vane insert 60 and a burner head 62. Particle catching pan 52 is attached to a gas fitting 64 which is attached to the end of main gas supply tube 24. Bracket 54 is attached to pan 52 and includes an upstanding flange 66 to which venturi air tube 56 is attached. Disposed within bracket 52 and attached to gas fitting 64 such that it extends into venturi air tube 56 is orifice fitting 58. Orifice fitting 58 is the supply outlet for gas burner 14 and directs gas from main gas supply tube 24 into venturi air tube 56. Combustion air enters venturi air tube 56 through the open ends of bracket 54 and around a gap 68 located between orifice fitting 58 and venturi air tube 56.

The design for orifice fitting 58 is such that it does not provide a settling station for airborne contamination particles. The exterior surface 69 of orifice fitting 58 forms an angle with respect to the axial center line of fitting 58 which must be less than 30° and in the preferred embodiment is 23°. This relatively steep angle discourages particles dropping down from inside venturi air tube 56 from settling on orifice fitting 58 and affecting its performance.

Turbo vane insert 60 is disposed within and attached to venturi air tube 56 downstream from orifice fitting 58 to improve the premixing of air and gas. The premixing of the air and gas by insert 60 and venturi air tube 56 lowers the carbon monoxide emissions of gas burner 14. Turbo vane insert 60 comprises a base 70 having a plurality of upstanding vanes 72. It has been found that by having vanes 72 angled with respect to the upper surface of base 70 at an angle 74 having a value of 30°, emissions from gas burner 14 decrease by approximately 50%.

Burner head 62 is attached to the end of venturi air tube 56 opposite to gas supply tube 24. Burner head 62 abuts a formed lower bead 76 and is secured in place by a formed upper bead 78. Burner head 62 comprises a lower burner head 80, an upper burner head 82, a carriage bolt 84 and a spacer 86.

Lower burner head 80 is a generally circular member having a plurality of semicircular gas ports 88 spaced equally around its circumference. In the preferred embodiment, there are 40 ports 88 spaced equally at 9°. The center of lower burner head 80 is dish-shaped and forms a generally flat section 90 which defines a generally circular aperture 92. Aperture 92 is designed to accept the open end of venturi air tube 56 such that lower burner head 80 abuts lower bead 76. Once lower burner head 80 is assembled over venturi air tube 56, upper bead 78 is formed to secure burner head 62 in place. The exterior circumferential edge of lower burner head 80 defines a plurality of slots 94 and tabs 96 alternately and evenly spaced around lower burner head 80. In the preferred embodiment, there are 4 slots 94 spaced 90° from each other and 4 tabs 96 spaced 90° from each other and 45° from a respective slot. Slots 94 and tabs 96 mate with an identical set of slots 94 and tabs 96 formed on upper burner head 82 to secure heads 80 and 82 together mechanically without brazing or welding.

Upper burner head 82 is a generally circular member having a plurality of semi-circular ports 98 spaced around its circumference in an identical pattern to ports 88 of lower burner head 80. The center of upper burner head 82 is dish-shaped and forms a generally flat section 100 which defines a generally square aperture 102. Aperture 102 is designed to accept the square shoulder on carriage bolt 84 to prohibit its rotation with respect to head 82, thus allowing a nut 104 to be tightened. The exterior circumferential edge of upper burner head 82 defines an additional plurality of slots 94 and 96 alternately and evenly spaced around upper burner head 82 in a pattern identical to that of lower burner head 80. After lower burner head 80 is secured to venturi air tube 56, carriage bolt 84 is inserted through aperture 102 of upper burner head 82. Upper burner head 82 is then aligned with lower burner head 80 such that tabs 96 on upper head 82 are aligned with slots 94 on lower head 80. This in turn aligns tabs 96 on lower head 80 with slots 94 on upper head 82. Tabs 96 on both heads 80 and 82 are then formed to mate with their aligned slot 94 and sandwich the other head to secure lower and upper heads 80 and 82 together without brazing or welding.

The assembly of heads 80 and 82 aligns the semi-circular ports 88 with the semi-circular ports 98 to form a plurality of generally circular ports 106. Ports 106 are resistive to the collecting an build up of dust and contamination due to their size and the fact that the precision metal stamping process for both heads 80 and 82 provides a very smooth interior surface. In addition, the control on the sizes of ports 88 and 98 and thus ports 104 provides accuracy for the performance characteristics of burner assemblies 10. While ports 106 are designed to be large in diameter to prevent clogging at the port face, they are resistant to flashback because the port wall depth is designed to be similar to the depth provided by the prior art cast iron burners. This resistance to flashback is of particular concern when propane gas is used because propane gas is currently the dominant fuel being used in burner assemblies for brooders.

The present invention thus provides a much lighter weight burner having common upper and lower burner heads which are mechanically joined rather than brazed or welded to provide a very low overall cost burner which gives consistent performance between individual burners and is essentially maintenance free.

While the above detailed description describes the preferred embodiment of the present invention, it should be understood that the present invention is susceptible to modification, variation and alteration without deviating from the scope and fair meaning of the subjoined claims.

What is claimed is:

1. A gas burner for an assembly having an inner core, a perforated radiant element attached to said inner core to form a burner chamber and a canopy attached to said radiant element, said gas burner being attached to said inner core and disposed within said burner chamber such that combustion gases from said gas burner pass through said burner chamber and through said perforated radiant element, said burner comprising:

a venturi tube;

an orifice fitting disposed at one end of said venturi tube;

a burner head assembly disposed at the opposite end of said venturi tube, said burner head assembly comprising:

a lower burner head attached to said venturi tube, said lower burner head having a generally consistent wall thickness and forming a first plurality of channels;

an upper burner head attached to said lower burner head, said upper burner head having a generally consistent wall thickness and forming a second plurality of channels in registry with said first plurality of channels of said lower burner head;

said lower burner head defining a first plurality of tabs and said upper burner head defining a first plurality of slots, said first tabs of said lower burner head extending through said first slots of said upper burner head overlying said upper burner to sandwich said upper burner head between said first tabs of said lower burner head and said lower burner head; and means for supplying gas to said gas burner.

2. The gas burner according to claim 1 wherein said upper burner head defines a second plurality of tabs and said lower burner head defines a second plurality of slots, said second tabs of said upper burner head extending through said second slots of said lower burner head and overlying said lower burner head to sandwich said lower burner head between said second tabs of said upper burner head and said upper burner head.

3. A gas burner for an assembly having an inner core, a perforated radiant element attached to said inner core to form a burner chamber and a canopy attached to said radiant element, said gas burner being attached to said inner core and disposed within said burner chamber such that combustion gases from said gas burner pass through said burner chamber and through said perforated radiant element, said burner comprising:

a venturi tube;

an orifice fitting disposed at one end of said venturi tube;

a burner head assembly disposed at the opposite end of said venturi tube, said burner head assembly comprising:

a lower burner head attached to said venturi tube, said lower burner head having a generally consistent wall thickness and forming a first plurality of channels;

an upper burner head attached to said lower burner head, said upper burner head having a generally consistent wall thickness and forming a second plurality of channels in registry with said first plurality of channels of said lower burner head;

said upper burner head defining a plurality of tabs and said lower burner head defining a plurality of slots, said tabs of said upper burner head extending through said slots of said lower burner head and overlying said lower burner to sandwich said lower burner head between said tabs of said upper burner head and said upper burner head; and means for supplying gas to said gas burner.

4. The gas burner according to claim 3 further comprising means for premixing air and gas disposed within said venturi tube between said orifice fitting and said burner head assembly.

5. The gas burner according to claim 3 further comprising a bracket attached to said venturi tube and said orifice fitting, said bracket aligning said orifice fitting said said venturi tube.

6. The gas burner according to claim 5 further comprising means for premixing air and gas disposed within said venturi tube between said orifice fitting and said burner head assembly.

7. A gas burner comprising:

a venturi tube;

an orifice fitting disposed at one end of said venturi tube;

a burner head assembly disposed at the opposite end of said venturi tube, said burner head assembly comprising:

a lower burner head attached to said venturi tube, said lower burner head having a generally consistent wall thickness and forming a first plurality of channels; and an upper burner head attached to said lower burner head, said upper burner head having a generally consistent wall thickness and forming a second plurality of channels in registry with said first plurality of channels of said lower burner head;

said lower burner head defining a first plurality of tabs and said upper burner head defining a first plurality of slots, said first tabs of said lower burner head extending through said first slots of said upper burner head and overlying said burner head to sandwich said upper burner head between said first tabs of said lower burner head and said lower burner head.

8. The gas burner according to claim 7 wherein said upper burner head defines a second plurality of tabs and said lower burner head defines a second plurality of slots, said second tabs of said upper burner head extending through said second slots of said lower burner head and overlying said lower burner head to sandwich said lower burner head between said second tabs of said upper burner head and said upper burner head.

9. A gas burner comprising:

a venturi tube;

an orifice fitting disposed at one end of said venturi tube;

a burner head assembly disposed at the opposite end of said venturi tube, said burner head assembly comprising:

a lower burner head attached to said venturi tube, said lower burner head having a generally consistent wall thickness and forming a first plurality of channels; and an upper burner head attached to said lower burner head, said upper burner head having a generally consistent wall thickness and forming a second plurality of channels in registry with said first plurality of channels of said lower burner head;

said upper burner head defining a plurality of tabs and said lower burner head defining a plurality of slots, said tabs and said upper burner head extending through said slots of said lower burner head overlying said lower burner head to sandwich said lower burner head between said tabs of said upper burner head and said upper burner head.

10. The gas burner according to claim 3 wherein said upper and lower burner heads are formed of stainless steel sheet metal.

* * * * *

UNITED STATES PATENT AND TRADEMARK OFFICE

CERTIFICATE OF CORRECTION

PATENT NO. : 5,964,214
DATED : October 12, 1999
INVENTOR(S) : William J. Ferlin et al It is certified that error appears in the above-identified patent and that said Letters Patent is hereby corrected as shown below:

On the Title Page, under Assignee, "Andereson" should be -- Anderson --.

Column 1, line 36, "born" should be -- borne --.

Column 1, line 60, "burn" should be -- borne --.

Column 3, line 12, "29" should be -- 20 --.

Column 4, line 35, "an" should be -- and --.

Column 4, line 39, "ports 104" should be -- ports 106 --.

Column 6, line 3, "said" (first occurrence) should be -- to --.

Signed and Sealed this

Fourth Day of July, 2000

*Attest:*

Q. TODD DICKINSON

*Attesting Officer*

*Director of Patents and Trademarks*